US008967406B1

(12) United States Patent
Cool et al.

(10) Patent No.: US 8,967,406 B1
(45) Date of Patent: Mar. 3, 2015

(54) DRINKING ATTACHMENT ASSEMBLY

(71) Applicants: Jacob A. Cool, Muncie, IN (US); Adrian Currie, Copperas Cove, TX (US); Amanda Currie, Copperas Cove, TX (US)

(72) Inventors: Jacob A. Cool, Muncie, IN (US); Adrian Currie, Copperas Cove, TX (US); Amanda Currie, Copperas Cove, TX (US)

( * ) Notice: Subject to any disclaimer, the term of this patent is extended or adjusted under 35 U.S.C. 154(b) by 0 days.

(21) Appl. No.: 14/165,672

(22) Filed: Jan. 28, 2014

(51) Int. Cl.
*B65D 51/16* (2006.01)
*B65D 47/32* (2006.01)
*B65D 23/04* (2006.01)

(52) U.S. Cl.
CPC ..... *B65D 23/04* (2013.01); *Y10S 215/902* (2013.01)
USPC ..... 215/309; 215/902; 215/387; 222/481; 222/464.1

(58) Field of Classification Search
USPC ..... 215/386, 902, 387, 307, 309, 229, 388; 220/694, 703, 705, 710; 222/481, 547, 222/464.1
See application file for complete search history.

(56) References Cited

U.S. PATENT DOCUMENTS

| | | | | |
|---|---|---|---|---|
| 577,410 | A | 2/1897 | Banker | |
| 1,243,963 | A | 10/1917 | Moser | |
| 1,341,826 | A | 6/1920 | Stewart | |
| 2,008,993 | A | 7/1935 | Petro | |
| 2,435,033 | A | 1/1948 | Campbell | |
| 4,938,395 | A | 7/1990 | Jamieson | |
| D320,136 | S | 9/1991 | Adock et al. | |
| 5,199,613 | A * | 4/1993 | Magrath et al. | 222/153.09 |
| 5,232,110 | A * | 8/1993 | Purnell | 215/312 |
| D418,753 | S | 1/2000 | DuBow | |
| 6,138,877 | A * | 10/2000 | Goff | 222/479 |
| 2007/0113893 | A1 | 5/2007 | Sun | |
| 2011/0192868 | A1* | 8/2011 | Kardos | 222/481.5 |
| 2013/0240574 | A1* | 9/2013 | George | 222/481 |

* cited by examiner

*Primary Examiner* — Fenn Mathew
*Assistant Examiner* — Jennifer Castriotta

(57) ABSTRACT

A drinking attachment assembly allows a user to drink a carbonated beverage more quickly by reintroducing air into a beverage bottle to remove the vacuum from the bottle. The assembly includes a tube having an open upper end and an open lower end. The lower end is configured for positioning within a beverage bottle filled with a carbonated fluid. The upper end is configured for being spaced from the fluid wherein the upper end is in fluid communication with ambient space surrounding the upper end such that air is transferred into the beverage bottle through the upper end. A coupler is attached to the tube. The coupler is configured to releasably couple the tube to a neck of the beverage bottle.

6 Claims, 4 Drawing Sheets

DRINKING ATTACHMENT ASSEMBLY

BACKGROUND OF THE DISCLOSURE

Field of the Disclosure

The disclosure relates to drinking devices and more particularly pertains to a new drinking device for allowing a user to drink a carbonated beverage more quickly by reintroducing air into a beverage bottle to remove the vacuum from the bottle.

SUMMARY OF THE DISCLOSURE

An embodiment of the disclosure meets the needs presented above by generally comprising a tube having an open upper end and an open lower end. The lower end is configured for positioning within a beverage bottle filled with a carbonated fluid. The upper end is configured for being spaced from the fluid wherein the upper end is in fluid communication with ambient space surrounding the upper end such that air is transferred into the beverage bottle through the upper end. A coupler is attached to the tube. The coupler is configured to releasably couple the tube to a neck of the beverage bottle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
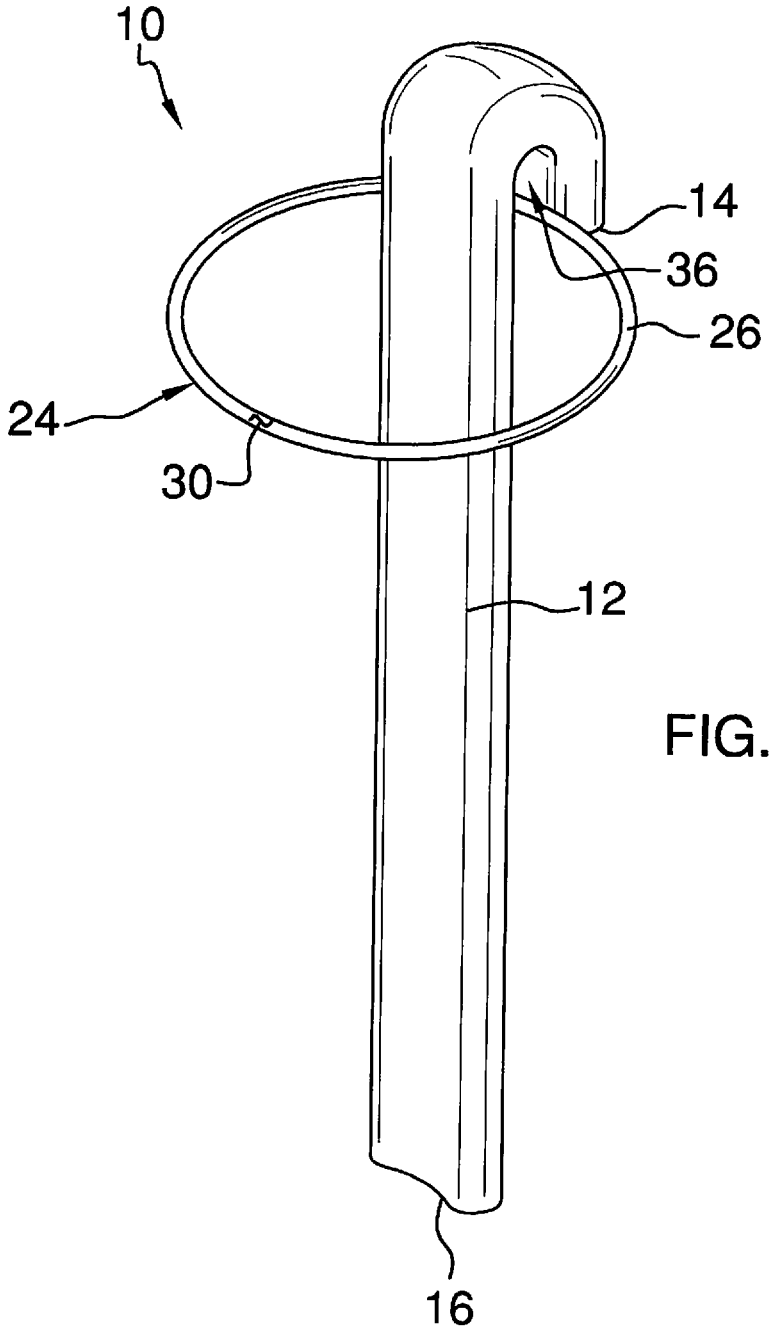
FIG. 1 is a top rear side perspective view of a drinking attachment assembly according to an embodiment of the disclosure.
Figure 2:
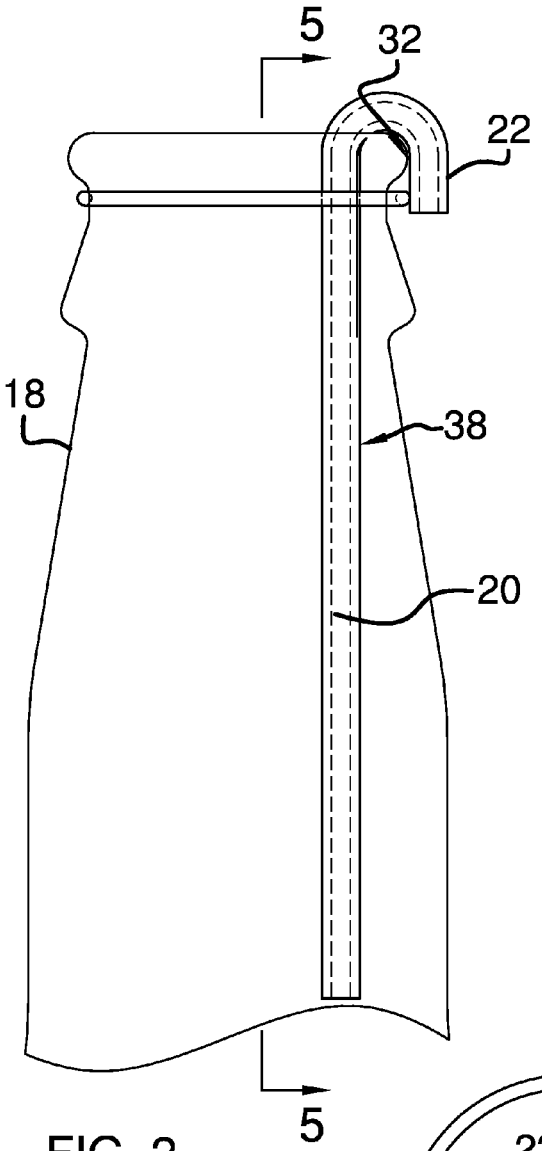
FIG. 2 is a side view of an embodiment of the disclosure in use.
Figure 3:
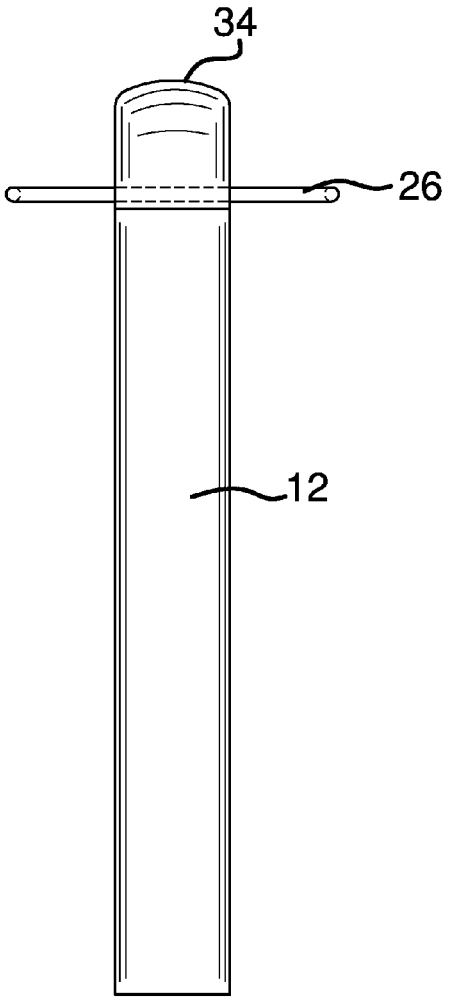
FIG. 3 is a front view of an embodiment of the disclosure.
Figure 4:
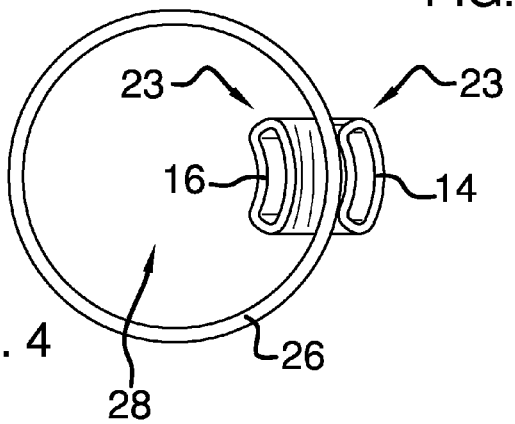
FIG. 4 is a bottom view of an embodiment of the disclosure.
Figure 5:
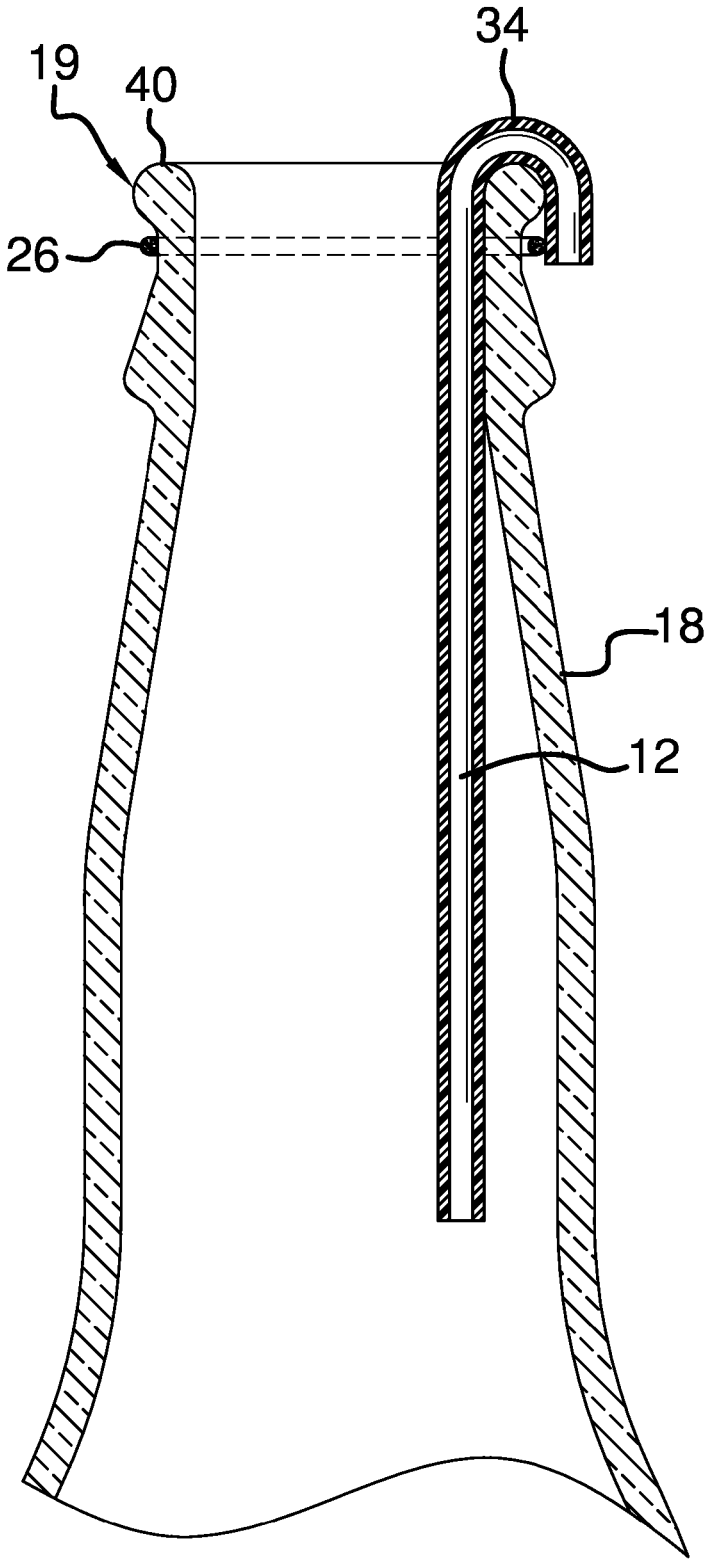
FIG. 5 is a cross-sectional view of an embodiment of the disclosure taken along line 5-5 of FIG. 2.

With reference now to the drawings, and in particular to FIGS. 1 through 6 thereof, a new drinking device embodying the principles and concepts of an embodiment of the disclosure and generally designated by the reference numeral 10 will be described.

As best illustrated in FIGS. 1 through 6, the drinking attachment assembly 10 generally comprises a tube 12 having an open upper end 14 and an open lower end 16. The lower end 16 is configured for positioning within a beverage bottle 18 filled with a carbonated fluid, such as beer, soda or the like. The upper end 14 is configured for being spaced from the fluid wherein the upper end 14 is in fluid communication with ambient space surrounding the upper end 14 such that air is transferred into the beverage bottle 18 through the upper end 14. This releases the vacuum within the beverage bottle 18, inhibits the fluid from generating foam while the fluid is being consumed, and permits the fluid to be consumed from the beverage bottle 18 more quickly than consuming the fluid in a conventional manner.

Figure 6:
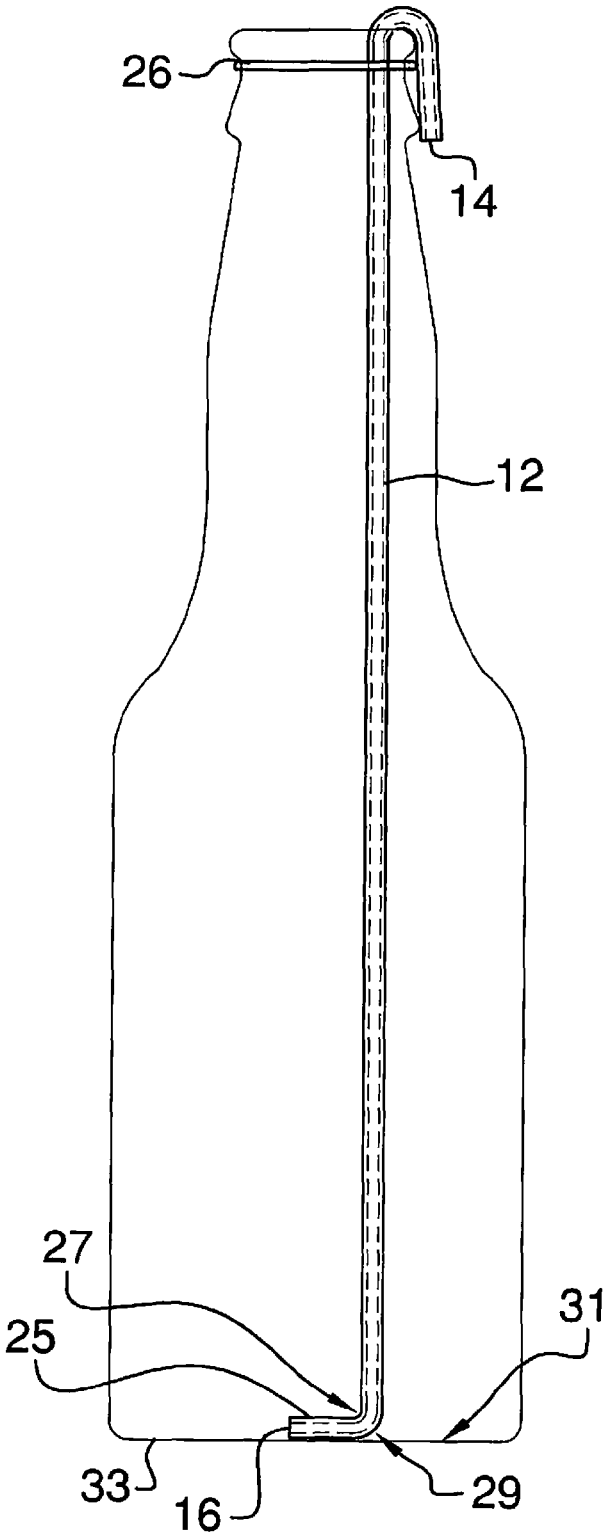
FIG. 6 is a side view of an alternative embodiment of the disclosure.

The tube 12 includes a straight portion 20 and an arcuate portion 22. The straight portion 20 includes the open lower end 16. The arcuate portion 22 includes the open upper end 14. Each of the open upper end 14 and the open lower end 16 has a crescent-shaped perimeter surface 23. In particular, each of the crescent-shaped perimeter surfaces 23 curves in a same direction relative to each other. The crescent-shaped perimeter surfaces 23 have substantially the same curvature as a portion of the coupler 24 to which the tube 12 is attached. The tube 12 may be either flexible or rigid. The lower end 16 may be beveled. Alternatively, as shown in FIG. 6, a bottom section 25 of the straight portion 20 may form an L-shaped bend 27 proximate the lower end 16 wherein a bottom surface 29 of the bottom section 25 is configured to abut an inner surface 31 of a bottom end 33 of the beverage bottle 18.

A coupler 24 is attached to the tube 12. The coupler 24 is configured to releasably couple the tube 12 to a neck 19 of the beverage bottle 18. The coupler 24 is non-removably coupled to the tube 12. The coupler 24 is resiliently flexible such that a size of the coupler 24 is selectively adjustable. The coupler 24 may comprise an annular band 26, such as a rubber band or the like, having a central opening 28 disposed therein. The straight portion 20 extends through the central opening 28. The coupler 24 is attached to the tube 12 proximate the upper end 14. An outer surface 30 of the coupler 24 abuts an inner surface 32 of the arcuate portion 22 proximate the upper end 14. The upper end 14 extends below the coupler 24. The tube 12 has an apex 34 extending above the coupler 24. The coupler 24 is positioned transversely relative to the straight portion 20.

A gap 36 is formed between an inner surface 38 of the straight portion 20 and the inner surface 32 of the arcuate portion 22. The gap 36 may be concavely arcuate. The gap 36 is configured to receive an upper edge 40 of the beverage bottle 18 therein such that the arcuate portion 22 is supported from the upper edge 40 of the beverage bottle 18. The assembly 10 may have a length extending from the open upper end 14 and the open lower end 16 between approximately 7.5 centimeters and 15.0 centimeters.

In use, as stated above and shown in the Figures, the straight portion 20 is positioned within the beverage bottle 18 so that the lower end 16 comes into contact with the fluid within the beverage bottle 18. The gap 36 is positioned to receive the upper edge 40 of the beverage bottle 18 so that the arcuate portion 22 is suspended from the upper edge 40. The coupler 24 is then extended around the neck 25 of the beverage bottle 18. A user drinks from the beverage bottle 18 in a conventional manner, except that the user's mouth is enclosed around the upper edge 40 of the beverage bottle 18 as well as the apex 34. However, it is important that the user does not obstruct the upper end 14 of the assembly 10 since the upper end 14 will allow air to enter the beverage bottle 18 and the vacuum to be released from the beverage bottle 18. This allows the fluid to produce less foam, which allows the user to drink the fluid more quickly than without the assembly 10. The assembly 10 can be stored and reused as desired.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A drinking attachment assembly comprising:

a tube having an open upper end and an open lower end, said lower end being configured for positioning within a beverage bottle filled with a carbonated fluid, said upper end being configured for being spaced from the fluid wherein said upper end is in fluid communication with ambient space surrounding said upper end such that air is transferred into the beverage bottle through said upper end, said tube including a straight portion, said straight portion including said lower end, said tube including an arcuate portion, said arcuate portion including said upper end, each of said upper end and said lower end extending having a crescent-shaped perimeter surface, each of said crescent-shaped perimeter surfaces curving in a same direction relative to each other; and a coupler attached to said tube, said coupler being configured to releasably couple said tube to a neck of the beverage bottle, said coupler comprising an annular band having a central opening disposed therein, said straight portion extending through said central opening, an outer surface of said coupler abutting an inner surface of said arcuate portion proximate said upper end, said upper end extending below said coupler; and a gap being formed between an inner surface of said straight portion and an inner surface of said arcuate portion, said gap being configured to receive an upper edge of the beverage container therein such that said arcuate portion is supported from the upper edge of the beverage container, said gap being concavely arcuate.

2. The assembly of claim 1, further comprising said coupler being non-removably coupled to said tube.

3. The assembly of claim 1, further comprising said coupler being resiliently flexible such that a size of said coupler is adjustable.

4. The assembly of claim 1, further comprising said coupler being attached to said tube proximate said upper end.

5. The assembly of claim 1, further comprising said coupler extending transversely relative to said straight portion.

6. A drinking attachment assembly comprising:

a tube having an open upper end and an open lower end, said lower end being configured for positioning within a beverage bottle filled with a carbonated fluid, said upper end being configured for being spaced from the fluid wherein said upper end is in fluid communication with ambient space surrounding said upper end such that air is transferred into the beverage bottle through said upper end, said tube including a straight portion and an arcuate portion, said straight portion including said lower end, said arcuate portion including said upper end, each of said upper end and said lower end extending having a crescent-shaped perimeter surface, each of said crescent-shaped perimeter surfaces curving in a same direction relative to each other, said tube being rigid;

a coupler attached to said tube, said coupler being configured to releasably couple said tube to a neck of the beverage bottle, said coupler being non-removably coupled to said tube, said coupler being resiliently flexible such that a size of said coupler is adjustable, said coupler comprising an annular band having a central opening disposed therein, said straight portion extending through said central opening, said coupler being attached to said tube proximate said upper end, an outer surface of said coupler abutting an inner surface of said arcuate portion proximate said upper end, said upper end extending below said coupler, said tube having an apex extending above said coupler, said coupler being positioned transversely relative to said straight portion; and a gap being formed between an inner surface of said straight portion and said inner surface of said arcuate portion, said gap being concavely arcuate, said gap being configured to receive an upper edge of the beverage container therein such that said arcuate portion is supported from the upper edge of the beverage container.

* * * * *